US006362723B1

(12) United States Patent
Kawase

(10) Patent No.: US 6,362,723 B1
(45) Date of Patent: Mar. 26, 2002

(54) CHIP THERMISTORS

(75) Inventor: Masahiko Kawase, Shiga (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/712,388

(22) Filed: Nov. 13, 2000

(30) Foreign Application Priority Data

Nov. 18, 1999 (JP) ..... 11-327696

(51) Int. Cl.[7] ..... H01C 7/10; H01C 7/13

(52) U.S. Cl. ..... 338/22 R; 338/307; 338/309; 338/313; 338/328; 338/332

(58) Field of Search ..... 338/22 R, 20, 338/21, 308, 309, 307, 313, 314, 328, 332, 327

(56) References Cited

U.S. PATENT DOCUMENTS 5,339,068 A * 8/1994 Tsunoda et al. ..... 338/332
6,008,717 A * 12/1999 Kawase et al. ..... 338/22 R
6,078,250 A * 6/2000 Ueda et al. ..... 338/313
6,136,246 A * 12/2000 Ueda et al. ..... 338/331

FOREIGN PATENT DOCUMENTS

JP 4-152601 * 5/1992
JP 6-314601 * 11/1994
JP 8-250308 * 9/1996
JP 8-321406 * 12/1996

* cited by examiner

*Primary Examiner*—Karl D. Easthom
*Assistant Examiner*—Kyung S. Lee
(74) *Attorney, Agent, or Firm*—Beyer Weaver & Thomas LLP

(57) ABSTRACT

A chip thermistor is produced by first preparing green sheets containing a thermistor ceramic material and an organic binder, then applying a resistor paste on one or more of these green sheets and an inner electrode paste on some others, and forming a layered structure by stacking and compressing together specified numbers of these green sheets. The layered structure is then subjected to a firing process and outer electrodes are formed on oppositely facing pair of outer end surfaces of the layered structure. The chip thermistor thus produced has a main body of a thermistor ceramic material having a specified resistance-temperature characteristic, a pair of outer electrodes on its end surfaces, at least one resistor having resistance greater than 1Ω, and at least one pair of inner electrodes opposite each other and separated from each other with the thermistor ceramic material in between. The resistor and the pair of inner electrodes are connected in series or in parallel between the pair of outer electrodes.

9 Claims, 5 Drawing Sheets

CHIP THERMISTORS

BACKGROUND OF THE INVENTION

This invention relates to chip thennistors. More particularly, this invention relates to composite electronic devices with a resistor and a chip thermistor.

Surface-mountable chip thermistors are coming to be widely used in recent years. As is well known, chip thermistors include both the PTC type and the NTC type, and the B-constant (the resistance-temperature characteristic) of an NTC thermistor is determined by the composition of the thermistor ceramic material to be used and has been difficult to control freely. For this reason, it has been a common practice to connect a resistor in series or in parallel with a thermistor to adjust the B-constant for each circuit to be in used. This not only adversely affects the workability but also requires a larger area to individually mount a resistor and a thermistor to a circuit board as individual electronic components.

In view of the above, Japanese Patent Publication Tokkai 64-1206 has disclosed a chip thermistor having a resistor layer formed between outer electrodes on its outer surface such that the thermistor and the resistor layer are connected in parallel. This has the advantage in that the area for the surface mounting can be reduced because the thermistor and the resistor are on a single chip and also in that the B-constant of the thermistor can be freely adjusted by varying the resistance of the resistor layer.

Chip thermistors thus structured, however, have a lower reliability because the resistor layer is externally exposed. In addition, errors are likely to be committed in their mounting, that is, they are likely to be mounted erroneously with the resistor layer on the side of the circuit board.

SUMMARY OF THE INVENTION

It is therefore an object of this invention to provide compact and reliable chip thermistors of which the B-constant can be adjusted easily and errors in mounting can be obviated.

A chip thermistor embodying this invention, with which the above and other objects can be accomplished, may be characterized as comprising a main body of a thermistor ceramic material having a specified resistance-temperature characteristic, outer electrodes formed on its outer end surfaces, at least one high-resistance conductor (or a "resistor") and inner electrodes inside the thermistor ceramic body and wherein the resistor and at least one mutually separated pair of inner electrodes with the thermistor ceramic material in between are electrically connected either in series or in parallel. Since a thermistor and a resistor are made into one chip according to this invention, it is possible to obtain a chip thermistor which is compact and of which the B-constant can be freely adjusted. Since the resistors are not externally exposed but are formed inside the thermistor ceramic, there is no danger of their erroneously contacting an external circuit at the time of mounting the chip thermistor. In other words, it is only the outer electrodes that are externally exposed, and this improves reliability. For the purpose of the present invention, the expression "high-resistance conductor" or "resistor" in defined as an electronic element with a much higher resistance than the inner electrodes, or an element with resistance greater than 1Ω, the resistance of the inner electrode being typically in the milliohm range.

The resistance value of the high-resistance conductors can be freely changed by connecting in series and/or parallel the inner electrodes facing each other and sandwiching the thermistor ceramic material in between. In order to obtain a larger resistance value, the resistors may be formed in the shape of a coil. This method is preferable because it is possible to increase the resistance value without being affected by the thermistor characteristic between the conductors.

Thermistors with negative thermistor-resistance characteristics (NTC thermistors) are widely in use for temperature compensation for a circuit element and temperature detection. The B-constant of such an NTC thermistor is determined by the material composition of the thermistor ceramics. The B-constant represents the magnitude of change in no-load resistance value against temperature and may be obtained from two arbitrary temperatures T and $T_0$ as follows:

$$B=\{\log\{R/R_0\}\}/\{(1/T)-(1/T_0)\} \quad \text{Formula (1)}$$

where T and $T_0$ are in units of absolute temperature (K) and R and $R_0$ are no-load temperature values at these temperatures in Ω. Since the ratio $R/R_0$ changes, the B-constant can be changed although the thermistor ceramics are the same.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, components which are equivalent or similar are indicated by the same numerals even where they are components of different chip thermistors and may not necessarily be described or explained repetitiously.

DETAILED DESCRIPTION OF THE INVENTION

Figure 1:
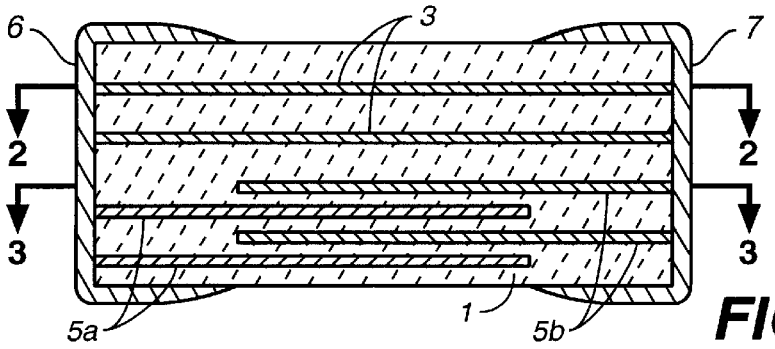
FIG. 1 is a sectional view of a chip thermistor according to a first embodiment of this invention.
Figure 2:
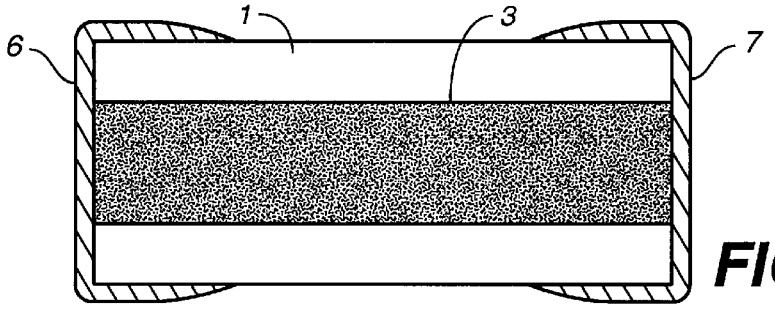
FIG. 2 is a sectional view taken along line 2—2 of FIG. 1.
Figure 3:
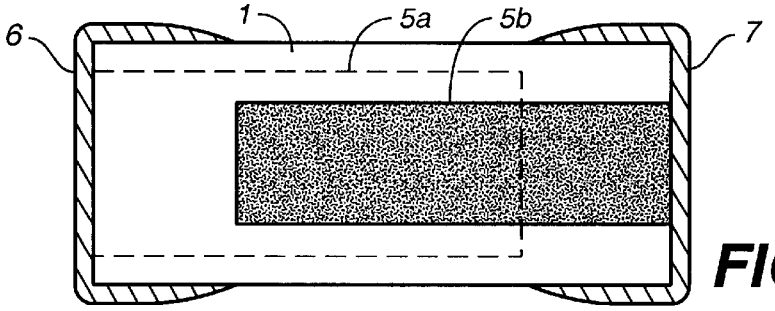
FIG. 3 is a sectional view taken along line 3—3 of FIG. 1.
Figure 4:
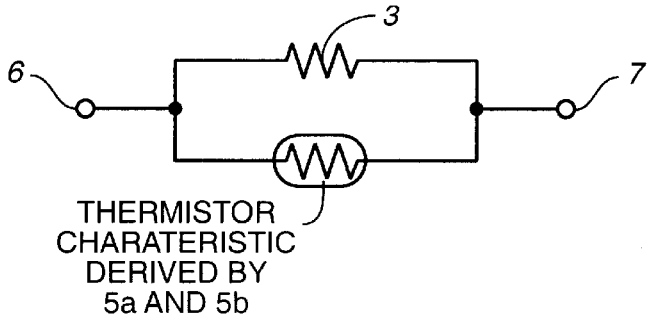
FIG. 4 is an equivalent circuit diagram of the chip thermistor of FIG. 1.

The invention is described next by way of examples. FIG. 1 shows a chip thermistor according to a first embodiment of this invention characterized as having planar elongated resistors 3 with resistance 1Ω or greater as shown in FIG. 2 and a plurality of planar elongated inner electrodes (first inner electrodes 5*a* and second inner electrodes 5*b*) extending in mutually opposite directions formed inside a ceramic body 1 made of a thermistor material with a desired resistance-temperature characteristic. Explained more in detail, the ceramic body 1 is planar, having an upper surface and a lower surface which are parallel and facing away from each other and extending between two mutually oppositely facing end surfaces. Both ends of each of the resistors 3 are exposed to the exterior on these end surfaces of the ceramic body 1. One end of each of the first inner electrodes 5*a* is exposed on one of the end surfaces, and one end of each of the second inner electrodes 5*b* is exposed on the other of the end surfaces of the ceramic body 1. Outer electrodes (the first outer electrode 6 and the second outer electrode 7) are formed each on corresponding one of the end surfaces of the ceramic body 1 such that one end of each of the resistors 3 and the exposed ends of the first inner electrodes 5*a* are electrically connected to the first outer electrode 6, while the other end of each of the resistors 3 and the exposed ends of the second outer electrodes 5*b* are electrically connected to the second outer electrode 7. Thus, the thermistor characteristic between the first and second inner electrodes 5*a* and 5*b* and the resistors 3 are connected in parallel through the outer electrodes 6 and 7, and its equivalent circuit diagram becomes as shown in FIG. 4.

Figure 5:
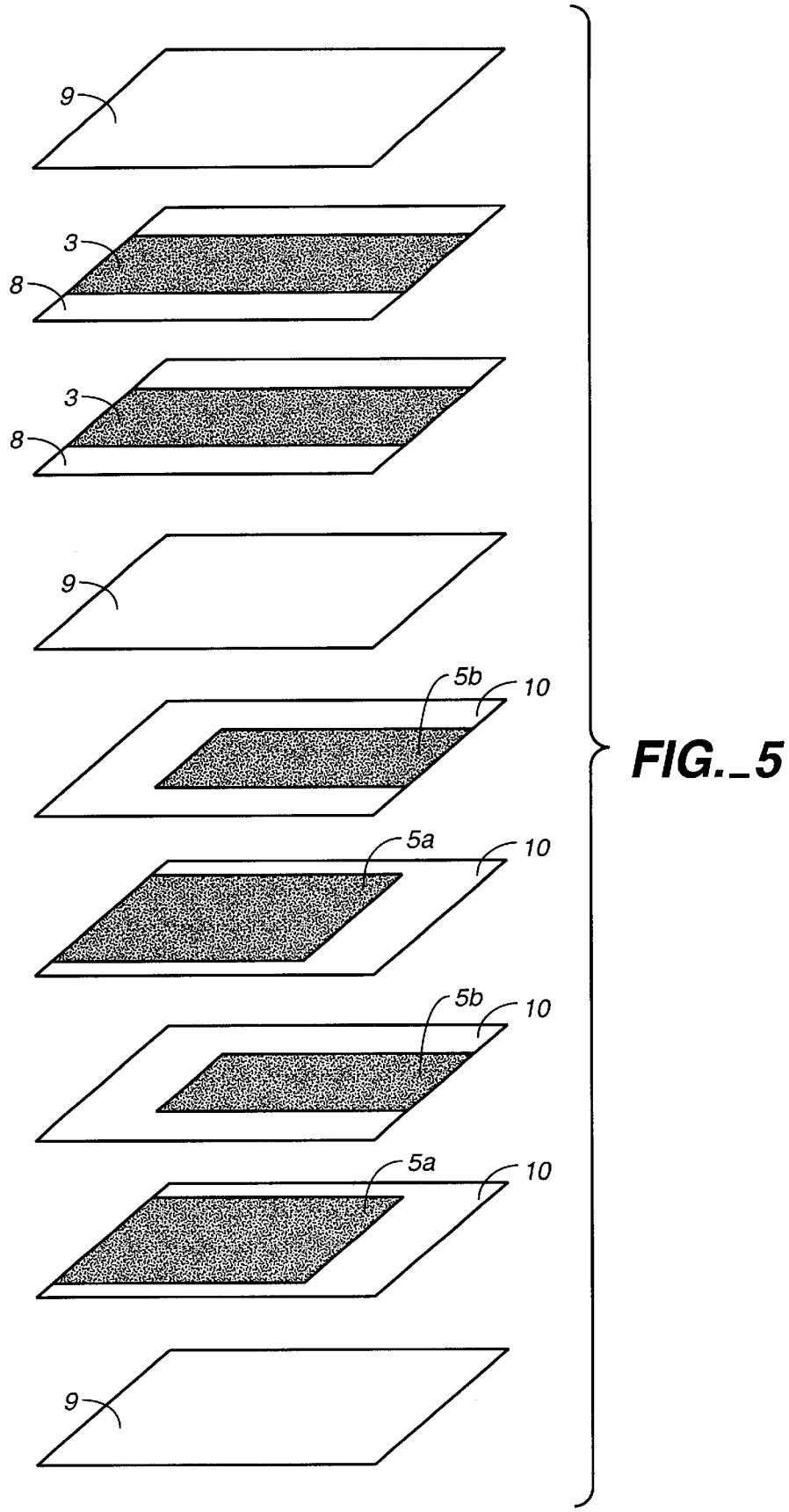
FIG. 5 is an exploded diagonal view of the chip thermistor of FIG. 1 for showing its layer structure.

As shown in FIG. 5, a specified number of ceramic layers 8 with a ceramic body 1 and a resistor 3 thereon which is elongated like a belt and narrower than the ceramic body 1 are stacked one above another, and cover sheets 9 each comprising one or more ceramic layers having no resistor thereon are placed below and above this stacked structure. Furthermore, several ceramic layers 10 each having a first inner electrode 5*a* or a second inner electrode 5*b* extending from a middle position to one or the other of the edge parts are stacked one above another such that the first and second inner electrodes 5*a* and 5*b* overlap partially, as seen perpendicularly to the layers. Another cover sheet 9 comprising one or more ceramic sheets having no electrode formed thereon is placed below the lowest of the ceramic layers 10 to form a composite layered structure. A chip thermistor is formed by forming outer electrodes 6 and 7 over the mutually oppositely facing end surfaces of this composite layered structure at which the resistors and the inner electrodes 5*a* and 5*b* are externally exposed.

A method by which such a chip thermistor was produced will be explained next. First, oxides of Mn, Ni and Co were mixed at a ratio of 52:12:32 (in wt %) and after the mixture was pre-baked, green sheets were produced by adding an organic binder, water, a dispersant and a surfactant and molding it in a sheet form. Sheets of a specified size were punched out from this green sheet and they were printed upon with an inner electrode paste which was a mixture of PdO and Pd at weight ratio of 10:0–50:50 and an inner electrode paste which was a mixture of Pd and Ag at weight ratio of 70:30. They were then stacked and compressed together.

A plurality of unit cells were formed on each green sheet. After the layers were stacked and compressed, as explained above, the stacked structure was cut appropriately and individual chip bodies were obtained. These chip bodies were then subjected to a firing process to obtain fired units. After surfaces of each fired unit were polished to expose the resistors 3 and the inner electrodes 5*a* and 5*b*, outer electrodes 6 and 7 were formed. The outer electrodes 6 and 7 may be formed by any of the known conventional methods such as firing of Ag, plating (Ni—Sn, Ni—Sn—Sn/Pb) and sputtering (monel-Ag-solder, Ag-solder). Although a parallel connection as shown in FIG. 1 of resistors and inner electrodes through outer electrodes was used to form an equivalent of a circuit shown in FIG. 4, they may be preliminarily connected through a throughhole inside the thermistor ceramic and then pulled out to the end surface to be connected to the outer electrodes.

Table 1 shows the overall resistance and overall B-constants of NTC thermistor single bodies (300 Ω and 100 Ω) and composites with a resistor and an NTC thermistor as shown in FIG. 1. The dimensions of the unit were 2mm in length, 1.20mm in width and 0.9 mm in thickness and the width of the belt-like resistor was 0.8 mm.

Examples of thermistor material for forming the green sheets include oxides of Mn, Ni, Co, Cu, Al and Fe. Materials for the resistor include PdO, Pd, $Lu_2O_3$, SiC and their mixtures. Examples for inner electrode paste include Ag, Ag—Pd, Pt and Pb.

Table 2 shows the resistance value of each of resistors 3 with length 2 mm, width 0.8 mm and thickness 0.001–0.1 mm, as shown in FIG. 1, produced with different materials.

TABLE 1

| (1) | (2) | (3) | (4) | (5) | (6) | (7) | (8) |
|---|---|---|---|---|---|---|---|
| 0:100 | 1 | 1000 | 300 | 3450 | 230.77 | 109.61 | 2869 |
| 25:75 | 1 | 500 | 300 | 3450 | 187.50 | 98.78 | 2470 |
| 25:75 | 2 | 250 | 300 | 3450 | 136.36 | 82.49 | 1937 |
| 40:60 | 1 | 125 | 300 | 3450 | 88.24 | 62.02 | 1359 |
| 0:100 | 1 | 1000 | 100 | 3450 | 90.91 | 39.42 | 3220 |
| 25:75 | 1 | 500 | 100 | 3450 | 83.33 | 37.92 | 3034 |
| 25:75 | 2 | 250 | 100 | 3450 | 71.43 | 35.25 | 2722 |
| 40:60 | 1 | 125 | 100 | 3450 | 55.56 | 30.89 | 2262 |
| 40:60 | 2 | 62.5 | 100 | 3450 | 38.46 | 24.77 | 1696 |

In Table 1:
(1) Ratio of PdO within resistor or Pd:PdO;
(2) Number of resistors;
(3) Resistance of resistor (Ω); Pd:PdO Pd:PdO
(4) Resistance of NTC (Ω);
(5) B-constant of NTC (K);
(6) Overall resistance at 25° C. (Ω);
(7) Overall resistance at 50° C. (Ω);
(8) Overall B constant b25/50 (K).

In Table 1
(1) Ratio of PdO within resistor or Pd:PdO;
(2) Number of resistors;
(3) Resistance of resistor (Ω);Pd:PdO Pd:PdO
(4) Resistance of NTC (Ω);
(5) B-constant of NTC (K);
(6) Overall resistance at 25° C. (Ω);
(7) Overall resistance at 50° C. (Ω);
(8) Overall B constant b25/50 (K).

TABLE 2

| Material | Content in Paste | Resistance (Ω) |
|---|---|---|
| Pd:PdO | 0:100 | 100 |
| Pd:Pdo | 10:90 | 700 |
| Pd:PdO | 25:75 | 500 |
| Pd:PdO | 40:60 | 125 |
| Pd:PdO | 50:50 | 10 |
| Pd:PdO | 75:25 | 5 |
| Pd:PdO | 90:10 | 2 |
| Pd:Cu | 25:75 | 2500 |
| Pd:Ni | 25:75 | |
| Pd:SiC | 25:75 | 200 |

TABLE 2-continued

| Material | Content in Paste | Resistance (Ω) |
|---|---|---|
| Ni | 100 | 30k |
| Cr | 100 | 150k |
| SiC | 100 | 1500 |
| Pd: Strontium titanate | 25:75 | 700 |
| Pd: Barium titanate | 25:75 | 3000 |

Materials shown in FIG. 2 were each used to produce a paste by mixing a solid component by 70 weight %, a resin component by 23 weight % and a solvent by 7 weight %. Each paste was applied by a screen printing method by selecting the viscosity of the paste and the kind of printing screen such that the thickness of the prints after drying would be 10–100μm. The firing process was carried out for 1–5 hours at 1000–1250° C. and by cooling at 200° C. Although PdO does not possess electrical conductivity, it is reduced during the firing process such that a portion thereof becomes metallic Pd and becomes electrically conductive. Thus, a resistor can be obtained even by using a paste containing only PdO but its resistance value can be more easily controlled by using a mixture of Pd and PdO as paste. In the case of Ni, Cr or Cu, a portion may oxidize, depending on the conditions of the firing process and the oxygen density, generating oxides such as NiO, $Cr_2O_3$ and CuO and thereby attaining a significantly high resistance value. The resistance value can further be controlled by mixing Pd. With SiC, strontium titanate and barium titanate, the elements in the thermistor are diffused to cause large changes in the resistance value. Mn and Fe, in particular, respond sensitively and increase the resistance value.

Table 1 shows clearly that the B-constant of a thermistor single body (3450K) can be varied significantly by varying the resistance of the resistor 3. Although the B-constant obtainable with a thermistor material is usually in the range of 2500K–4500K, it was possible by making a composite with a resistor to obtain a low B-constant value such as 1359K which could not be obtained before. Since the resistance value can be changed at will by varying the shape, the number of layers and the material of the resistor 3, the B-constant value can accordingly be varied to a large extent. Depending on the combination of the resistance of the material for the resistor and the resistance of the NTC thermistor, the B-constant can be made as small as the temperature coefficient of the resistor.

Figure 6A:
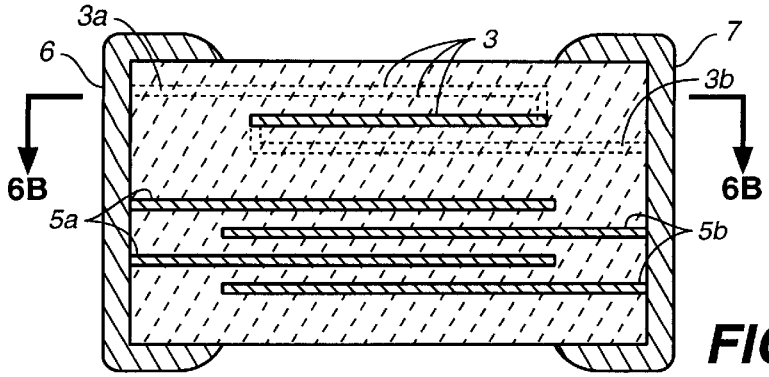
FIG. 6A is a sectional side view of another chip thermistor according to a second embodiment of this invention taken along line 6A—6A of FIG. 6B.
Figure 6B:
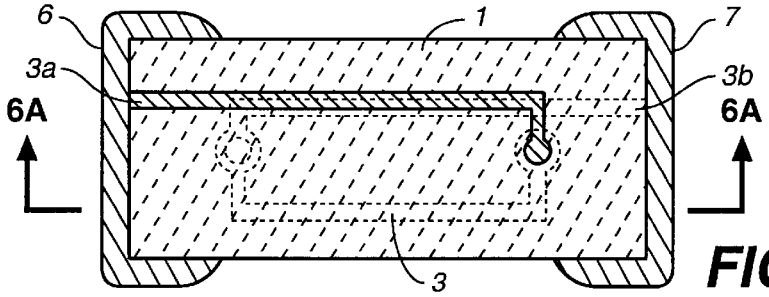
FIG. 6B is a sectional view taken along line 6B—6B of FIG. 6A.
Figure 7:
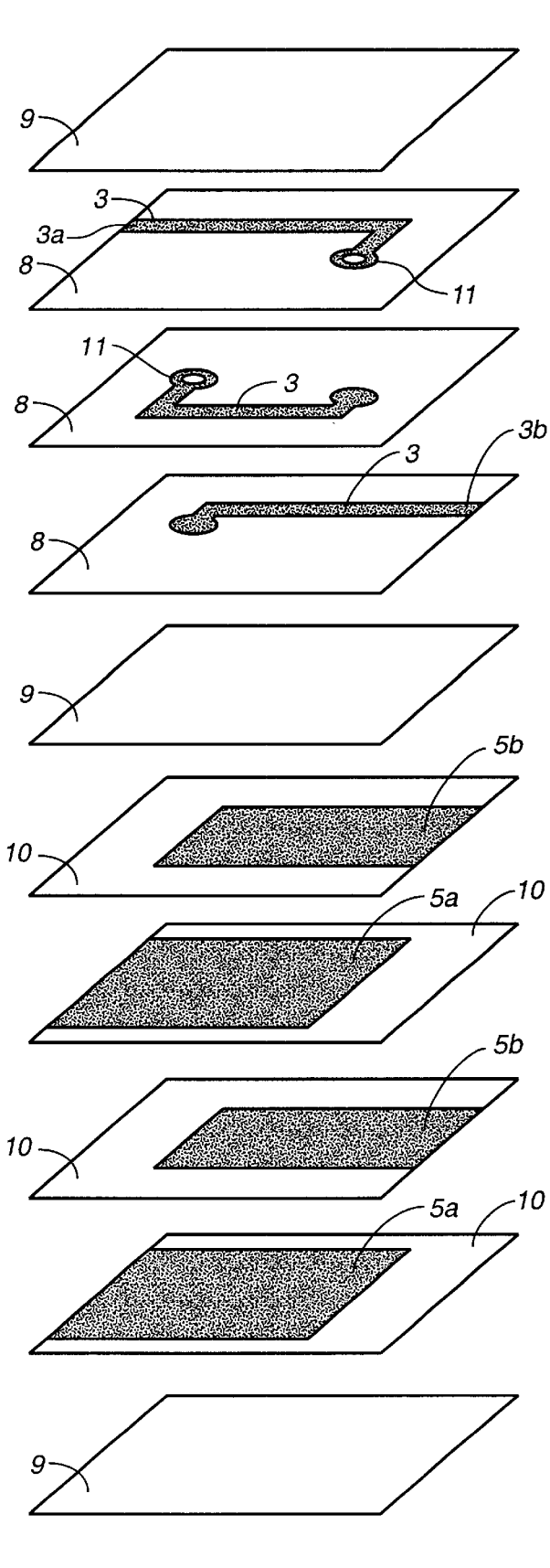
FIG. 7 is an exploded diagonal view of the chip thermistor of FIG. 6 for showing its layer structure.

FIGS. 6A, 6B and 7 show another chip thermistor according to a second embodiment of the invention, characterized in that resistors 3 are formed in the shape of a coil connected in parallel with the inner electrodes 5*a* and 5*b*. As shown in FIG. 7, a plurality of ceramic layers 8 each having an L-shaped resistor 3 formed on the upper surface are stacked and these resistors 3 on different ceramic layers 8 are connected through conductors buried in throughholes 11 such that a spiraling coil is formed. For forming the resistors 3 in the shape of such a coil, the resistors 3 on only the top and bottom of these plurality of ceramic layers 8 extend to one of the edges (as indicated by 3*a* and 3*b*) to be connected to the outer electrodes 6 and 7. In this example, too, the shapes of the resistors high-resistance conductors 3 and the number of the ceramic layers 8 are determined according to the target resistance for the chip thermistor. The inner electrodes 5*a* and 5*b* and the cover sheets 9 are as explained above with reference to the first embodiment of the invention shown in FIG. 5.

This embodiment is advantageous in that higher resistance values can be obtained than the first embodiment of the invention because the resistors 3 are formed in the shape of a coil. A higher resistance value can be otherwise obtained, for example, by forming the resistors 3 in a zigzag pattern or by reducing the width but resistive conductors with an excessively small width are likely to become broken and a zigzag pattern tends to cause a short circuiting if the separation between zigzagging lines is made too small. By forming the resistors 3 in the shape of a coil, it is possible to increase the resistance value without causing any line breakage or short circuiting.

Figure 8A:
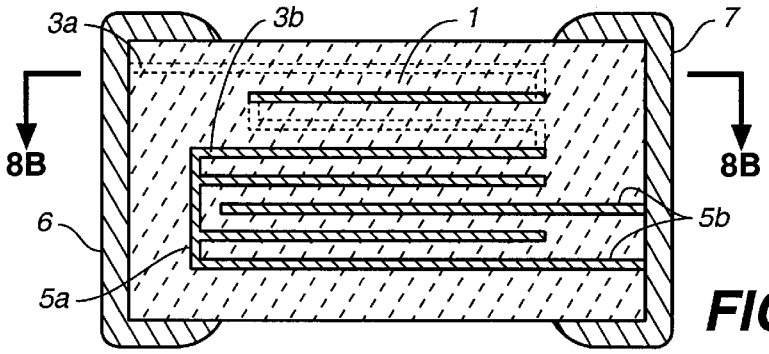
FIG. 8A is a sectional side view of still another chip thermistor according to a third embodiment of this invention taken along line 8A—8A of FIG. 8B.
Figure 8B:
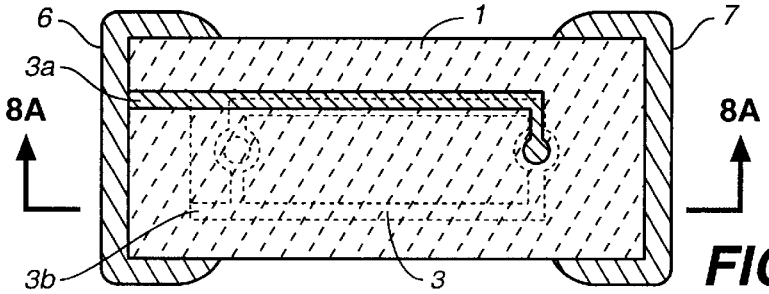
FIG. 8B is a sectional view taken along line 8B—8B of FIG. 8A.
Figure 9:
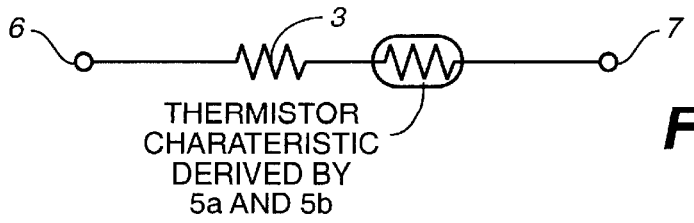
FIG. 9 is an equivalent circuit diagram of the chip thermistor of FIG. 8.

FIGS. 8A and 8B show still another chip thermistor according to a third embodiment of the invention, and FIG. 9 is its equivalent circuit diagram. This example is similar to the second embodiment of the invention in that the resistors 3 are formed in the shape of a coil but different therefrom in that the resistors 3 and the inner electrodes 5*a* and 5*b* are connected in series. In other words, one end 3*a* of one resistor 3 is connected to the first outer electrode 6, the other end 3*b* is connected to the first inner electrodes 5*a* and the second inner electrode 5*b* is connected to the second outer electrode 7. The first inner electrodes 5*a* not contacting the first outer electrode 6, it should be clear from FIGS. 8A and 8B that an equivalent circuit diagram for this chip thermistor is as shown in FIG. 9. As should be clear from Formula (1) above, the ratio $R/R_0$ can be varied in this example by connecting the resistors 3 in series with the inner electrodes 5*a* and 5*b* and hence the B-constant can be adjusted.

Figure 10A:
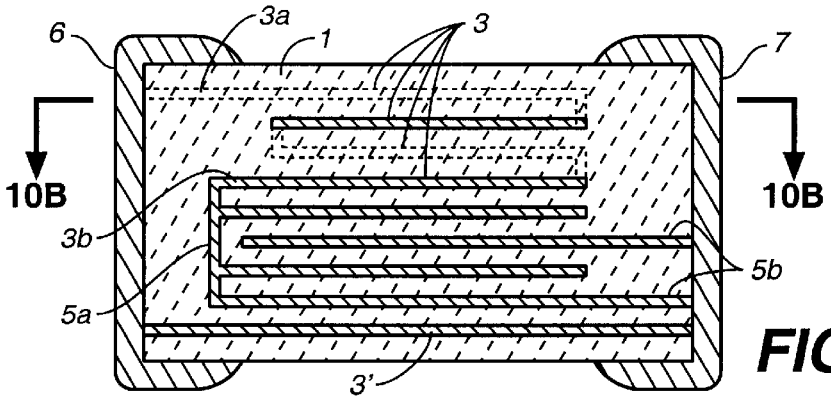
FIG. 10A is a sectional side view of still another chip thermistor according to a fourth embodiment of this invention taken along line 10A—10A of FIG. 10B.
Figure 10B:
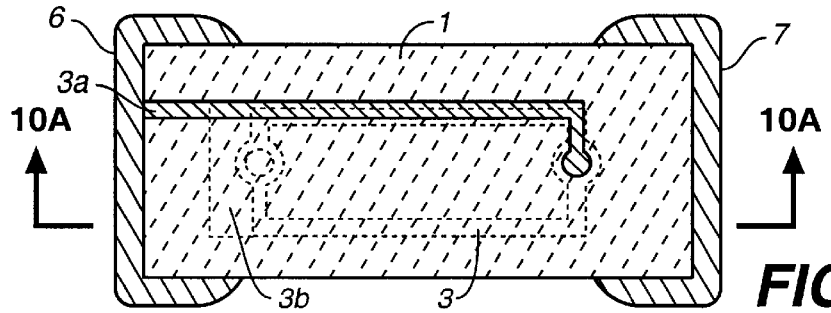
FIG. 10B is a sectional view taken along line 10B—10B of FIG. 10A.
Figure 11:
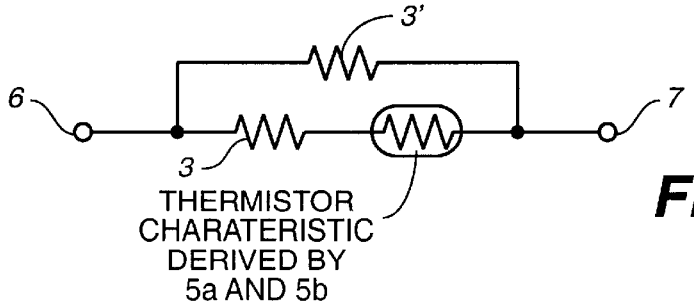
FIG. 11 is an equivalent circuit diagram of the chip thermistor of FIG. 10.

FIGS. 10A and 10B show still another chip thermistor according to a fourth embodiment of this invention, and FIG. 11 is its equivalent circuit diagram. This embodiment is different from the third embodiment explained above with reference to FIGS. 8A, 8B and 9 in that there is an additional resistor 3' provided inside the ceramic body 1 with one of its ends contacting the first outer electrode 6 and the other of its ends contacting the second outer electrode 7. In other words, this additional resistor 3' is connected in parallel with the aforementioned series connection of the resistors 3 and the inner electrodes 5*a* and 5*b*. Thus, the equivalent circuit diagram of this chip thermistor is as shown in FIG. 11. It now goes without saying that chip thermistors according to the fourth embodiment of the invention have the characteristics of chip thermistors according to both the first and the third embodiments of the invention.

Although the invention has been described with reference to only a limited number of embodiments, these embodiments are not intended to limit the scope of the invention. Although only embodiments having no more than one series or parallel connection were illustrated above, connections may be provided between a plurality of series and/or parallel connections. Although the invention was described by way of examples using NTC thermistors, it is also possible to use PTC thermistors. If PTC thermistors are used, the resistance increases as the temperature is increased but the manner in which the resistance increases (or the increase characteristic) can be varied by connecting resistors in series or parallel. PTC materials which may be used for producing chip thermistors of this invention may be obtained, for example, by adding oxide of yttrium, Mn or Pb to barium titanate.

Although a production method wherein layers of different kinds are stacked together and then subjected to a firing process, these layers may be individually subjected to a firing process and then pasted together by using, for example, a glass paste comprising lead borosilicate. The stacked composite structure thus obtained is thereafter cut to a desired chip size to obtain individual chip bodies.

When a plurality of green sheets with an inner electrode formed thereon are stacked and then subjected to a firing process, electric charge of the material for the electrodes may shift to the ceramic material to thereby generate a voltage difference. This may produce a barrier layer serving as an electrical wall to make it difficult to attain the desired resistance. In order to obviate problems of this nature, it may be preferable to form inner electrodes on ceramic plates which have already been subjected to a firing process and to stack and paste them together through a resistor layer.

Although examples were shown wherein the inner electrodes 5*a* and 5*b* are arranged so as to overlap as seen perpendicularly to their planes, this is not intended to limit the scope of the invention. These inner electrodes 5*a* and 5*b* may be coplanar, facing each other with a gap in between on the same plane or they may be arranged in a step-wise relationship, although not separately illustrated.

In summary, the disclosure is intended to be interpreted broadly and all modifications and variations of the disclosed examples that may be apparent to a person skilled in the art are intended to be within the scope of this invention.

What is claimed is:

1. A chip thermistor comprising:

a main body of a thermistor ceramic material having a specified resistance-temperature characteristic, said main body having a mutually oppositely facing pair of outer end surfaces;

a first outer electrode on one of said outer end surfaces;

a second outer electrode on the other of said outer end surfaces;

at least one resistor with resistance greater than 1Ω and at least one pair of inner electrodes inside said main body, said pair of inner electrodes being opposite each other with said thermistor ceramic material in between, said one resistor and said pair of inner electrodes being electrically connected between said first outer electrode and said second electrode.

2. The chip thermistor of claim 1 wherein said one resistor has one end in contact with said first outer electrode and the other end in contact with said second outer electrode, wherein said pair of inner electrodes includes a first inner electrode which contacts said first outer electrode and a second inner electrode which contacts said second outer electrode.

3. The chip thermistor of claim 2 wherein said thermistor ceramic material has a negative temperature-resistance characteristic.

4. The chip thermistor of claim 2 wherein said one resistor is shaped as a coil.

5. The chip thermistor of claim 1 wherein said one resistor has one end in contact with said first outer electrode, and wherein said pair of inner electrodes includes a first inner electrode which contacts the other end of said resistor and a second inner electrodes in contact with said second outer electrode.

6. The chip thermistor of claim 5 wherein said thermistor ceramic material has a negative temperature-resistance characteristic.

7. The chip thermistor of claim 5 wherein said one resistor is shaped as a coil.

8. The chip thermistor of claim 1 wherein said thermistor ceramic material has a negative temperature-resistance characteristic.

9. The chip thermistor of claim 1 wherein said one resistor is shaped as a coil.

* * * * *